US011352179B2

(12) United States Patent
Cabouli

(10) Patent No.: US 11,352,179 B2
(45) Date of Patent: Jun. 7, 2022

(54) BIOMETRIC LOCKING JAR WITH INTEGRATED VACUUM PUMP

(71) Applicant: Steven D. Cabouli, San Diego, CA (US)

(72) Inventor: Steven D. Cabouli, San Diego, CA (US)

( * ) Notice: Subject to any disclaimer, the term of this patent is extended or adjusted under 35 U.S.C. 154(b) by 71 days.

(21) Appl. No.: 16/540,136

(22) Filed: Aug. 14, 2019

(65) Prior Publication Data

US 2019/0367233 A1 Dec. 5, 2019

Related U.S. Application Data

(63) Continuation of application No. 15/893,617, filed on Feb. 10, 2018, now abandoned.

(51) Int. Cl.

| | |
|---|---|
| ***B65D 55/14*** | (2006.01) |
| ***G07C 9/00*** | (2020.01) |
| ***B65D 45/32*** | (2006.01) |
| ***G07C 9/37*** | (2020.01) |
| ***G07C 9/25*** | (2020.01) |
| ***F04B 37/14*** | (2006.01) |
| ***F04B 17/06*** | (2006.01) |
| ***F04B 19/04*** | (2006.01) |

(52) U.S. Cl.

CPC ..... *B65D 55/14* (2013.01); *B65D 45/327* (2013.01); *G07C 9/00563* (2013.01); *G07C 9/257* (2020.01); *G07C 9/37* (2020.01); *B65D 2251/20* (2013.01); *B65D 2543/00953* (2013.01); *F04B 17/06* (2013.01); *F04B 19/04* (2013.01); *F04B 37/14* (2013.01); *G07C 2209/40* (2013.01); *G07C 2209/60* (2013.01)

(58) Field of Classification Search

CPC .. B65D 55/14; B65D 45/327; B65D 2251/20; B65D 2543/00953; B65D 2203/12; G07C 9/37; G07C 9/257; G07C 9/00563; G07C 2209/40; G07C 2209/60; G07C 9/00182; G07C 9/00912; F04B 37/14; F04B 17/06; F04B 19/04

USPC ..... 340/5.1; 141/65

See application file for complete search history.

(56) References Cited

U.S. PATENT DOCUMENTS 4,372,096 A * 2/1983 Baum ..... B67B 3/24 53/103

5,765,608 A * 6/1998 Kristen ..... B65B 31/047 141/198

(Continued)

*Primary Examiner* — Nam V Nguyen

(74) *Attorney, Agent, or Firm* — Richard D. Clarke

(57) ABSTRACT

This application is directed to a Biometric Locking Jar with Integrated Vacuum Pump. More particularly, this application provides a biometric locking lid capable of interfacing with a jar or other container, wherein the biometric locking lid includes a built-in electrically powered vacuum pump and a labyrinth seal lid gasket which acts to lock the jar from unauthorized access by pulling a vacuum within the jar and securing the lid to the jar preventing unauthorized access to the contents of the jar. A user enrolls a fingerprint or thumb print. The vacuum pump is activated by scanning and recognizing a user's enrolled fingerprint. The locking jar may be used to keep contents secure and fresh, and also out of the reach of children or other unauthorized individuals as it employs the user's fingerprint or thumb print to release the vacuum and open the jar, allowing access to the contents inside.

20 Claims, 9 Drawing Sheets

(56) References Cited

U.S. PATENT DOCUMENTS

| | | | | |
|---|---|---|---|---|
| 6,382,416 | B1 * | 5/2002 | Gainey | A61J 1/1437 206/1.5 |
| 6,626,314 | B1 * | 9/2003 | McHenry | B65D 47/265 220/255 |
| 6,786,346 | B1 * | 9/2004 | Gurnard | B65D 55/145 220/320 |
| 6,789,690 | B2 * | 9/2004 | Nieh | B65D 81/2015 215/228 |
| 7,021,034 | B2 * | 4/2006 | Higer | B65B 31/00 53/510 |
| 7,048,136 | B2 * | 5/2006 | Havens | B65D 51/1644 206/524.8 |
| 8,237,541 | B2 * | 8/2012 | Wang | B65D 55/14 340/5.53 |
| 8,488,314 | B1 * | 7/2013 | Ashcraft | G06F 1/1679 361/679.58 |
| 8,640,904 | B2 * | 2/2014 | Steininger | B65D 47/265 220/253 |
| 9,758,989 | B1 * | 9/2017 | Simpson | B65D 50/00 |
| 9,908,673 | B2 * | 3/2018 | Rogers | G07F 13/00 |
| 9,911,261 | B2 * | 3/2018 | Gordon | G07C 9/33 |
| 10,894,643 | B2 * | 1/2021 | Leary | B65D 55/14 |
| 2009/0223994 | A1 * | 9/2009 | Getz | B65D 55/14 221/154 |
| 2017/0281467 | A1 * | 10/2017 | Solotoff | B65D 55/02 |
| 2018/0058435 | A1 * | 3/2018 | Laurent | F04B 37/14 |

* cited by examiner

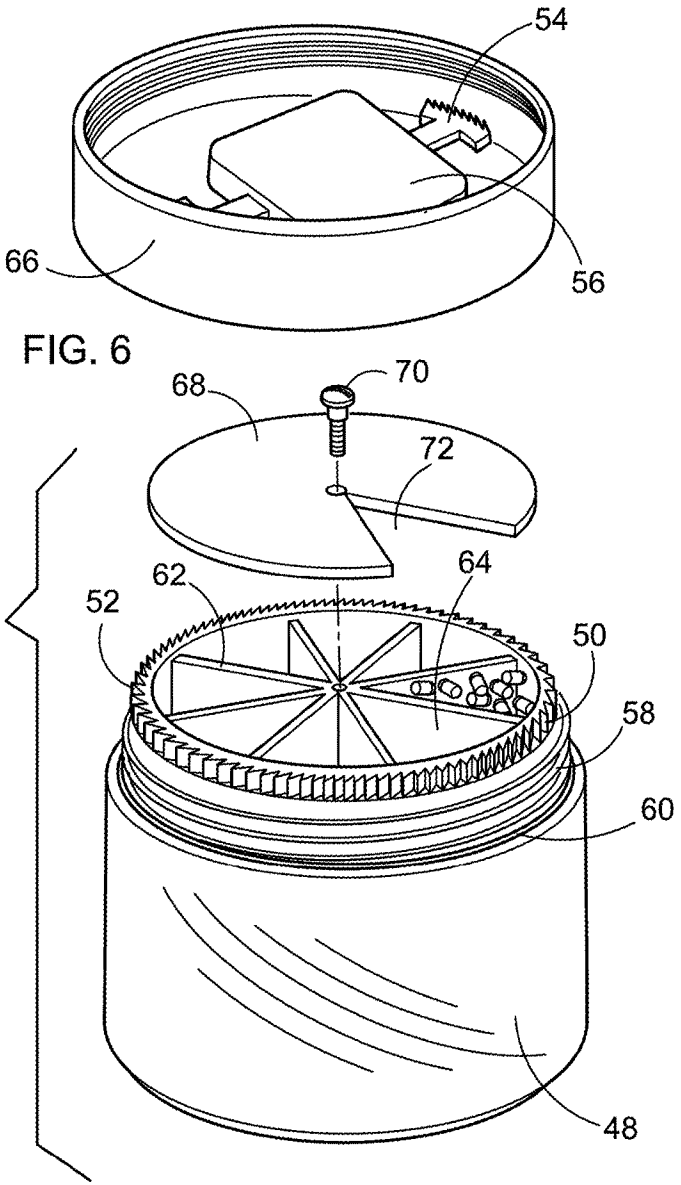
FIG. 6
FIG. 5
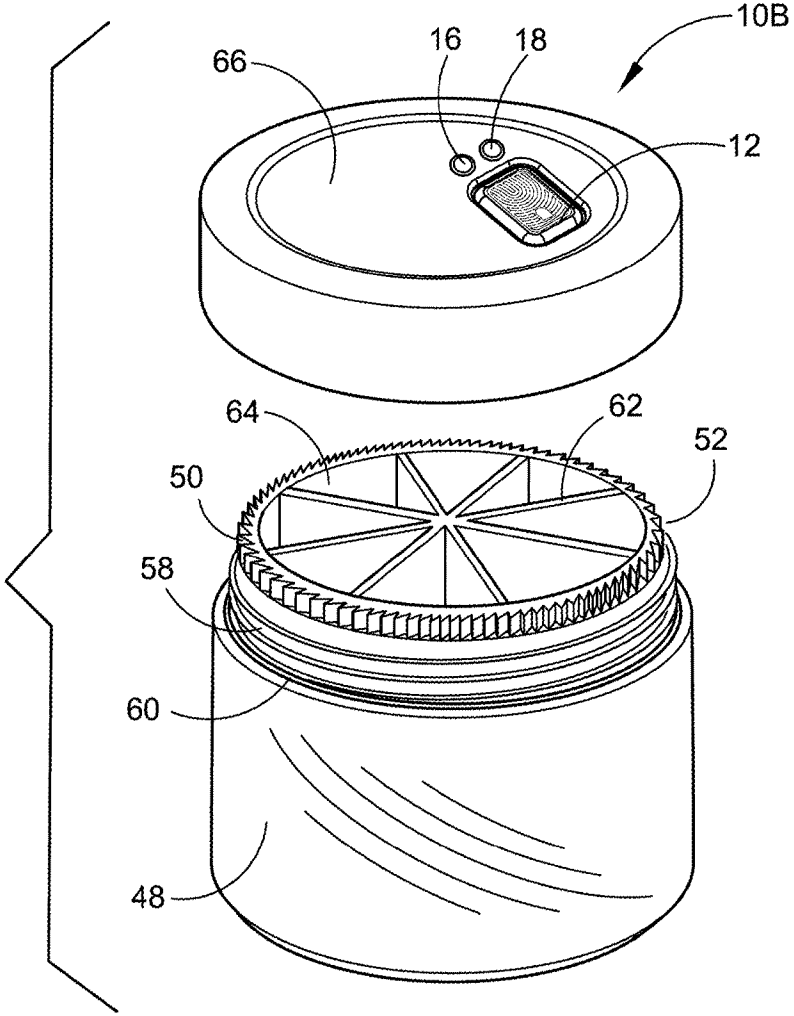
FIG. 4

BIOMETRIC LOCKING JAR WITH INTEGRATED VACUUM PUMP

CROSS-REFERENCE TO RELATED APPLICATIONS

The present non-provisional patent application is a continuation-in-part of Applicant's co-pending patent application Ser. No. 15/893,617 filed on Feb. 10, 2018, now abandoned.

FIELD OF THE INVENTION

This application is directed to a Biometric Locking Jar with Integrated Vacuum Pump. More particularly, this application provides a biometric lock on a jar lid having a built-in electrically powered vacuum pump and lid gasket which acts to lock the jar from unauthorized access by pulling a vacuum within the jar. The locking jar may be used to keep contents secure and fresh, and also out of the reach of children or other unauthorized individuals as it employs the user's fingerprint or thumb print to open the jar and allow access to the contents inside.

BACKGROUND OF THE INVENTION

There is growing need to provide an adequate safe means to store substances in an airtight and safe environment, such as Cannabis and Opioids, or pills that may be harmful to adults or children if left in open containers with free access. The Biometric Locking Jar with Integrated Vacuum Pump system offers a new and unique fingerprint or thumb print enrollment/reader for opening the devices without the use of cumbersome keys that can be easily misplaced or lost. Cannabis, Opioids and other drugs may be useful and legal to possess but can also be deadly for children and adults that are not responsible for their actions and should be handled with great caution. The Biometric Locking Jar with Integrated Vacuum Pump of the present invention seals and locks through the use of a vacuum, that is, when a vacuum is pulled on the jar, the lid will not come off.

In some circumstances, the tobacco-like articles may be stored in clear glass containers in a manner that permits excessive moisture migration into or out of the material. For example, moist Cannabis should not be stored in a manner that permits significant migration of moisture in and out of the container during both the product shelf life and the period of consumer use. Such moisture egress from the containers can cause the moist Cannabis to lose moisture and suffer a loss of freshness characteristics as well as negatively impact on desirable qualities of other tobacco like products.

Numerous innovations for containers have been provided in the prior art described as follows. Even though these innovations may be suitable for the specific individual purposes to which they address, they differ from the present Biometric Locking Jar with Integrated Vacuum Pump as hereinafter contrasted. The following is a summary of those prior art patents most relevant to the Biometric Locking Jar with Integrated Vacuum Pump at hand, as well as a description outlining the difference between the features of the present application and those of the prior art.

U.S. Pat. No. 8,556,070 of David Karl Bried et al. describes a tobacco product package device that can be used to enhance freshness and other characteristics of tobacco products or other products contained therein. Certain features can improve product freshness both during shelf life and during consumer use.

This patent describes a tobacco product package device that can be used to enhance freshness and other characteristics of tobacco products or other products contained therein but does not describe the unique biometric locking system using the finger or thumb unlocking means or anything similar to the Biometric Locking Jar with Integrated Vacuum Pump that will be made from a smoke tinted glass or a high-grade smoke tinted polymer, as well as from metals, alloys and composite materials.

U.S. Pat. No. 9,572,748 of Kevin Lim et al. describes a container that includes a chamber to hold a medication, a lockable lid that covers an opening of the chamber, a biometric sensor, a scale, and one or more processors. The container may store prescription information indicating how often the medication should be provided. The container may measure a weight of the medication held by the chamber using the scale. The container may receive biometric information sensed by the biometric sensor. The biometric information may indicate a biometric feature of a person attempting to open the container. The container may selectively unlock the lockable lid based on at least one of the prescription information, the weight of the medication, or the biometric information.

This patent describes a product package device for holding medications with a lockable lid that covers an opening of the chamber, a biometric sensor, a scale, and one or more processors. This patent deals with an involved service piece of equipment that requires a computer network to effectively work and does not describe a container for dispensing or hold pills or Cannibals or have the biometric fingerprint or thumb print locking means.

U.S. Pat. No. 9,630,747 of William Thomas Smith et al. describes a container for displaying, visualizing, and aroma sampling botanical materials—such as tea, cannabis, and the like including a container body, lid, and lens. The container body is shaped to define a mounting projection wherein a sample, such as a botanical sample, may be held. Container body and lid form an airtight seal. A sample may be visualized through the lens. In a preferred embodiment, lid is shaped to define scent openings permitting aroma sampling of a sample contained within. In one embodiment option, one or more projections secure a card bearing sample identification information.

This patent describes a container for displaying, visualizing, and aroma sampling botanical materials. This container would not offer the airtight seal and the biometric finger or thumb locking means on a compact or jar style of container.

US Patent Application Publication No. 2017/0190482 of William Thomas Smith et al. describes embodiment containers for displaying, visualizing, and aroma sampling botanical materials—such as tea, cannabis, and the like including a container body, lid, and lens—which may have various shapes. In a preferred embodiment, lid is shaped to define a recessed area with scent openings permitting aroma sampling of a sample contained within. A removable plug is shaped to fit within the recessed area of the lid. The container body and lid, with removable plug fit within the lid, form an airtight chamber within. A botanical sample may be visualized through the lens.

This patent describes a second container for displaying, visualizing, and aroma sampling of botanical materials such as tea and cannabis where a botanical sample may be visualized through the lens by readjusting the holding components of the device.

U.S. Pat. No. 9,869,978 of Mathew R. Gibertson et al. describes a method for commissioning a collection of electronic locks by inserting the same electronic key into each of the locks and recording in the electronic key an internal code unique to that lock which identifies the lock and is needed to open the lock and a method for biometrically permitting controlled secure access to a container having one of the commissioned electronic locks.

This patent describes a method for biometrically permitting controlled secure access to a container having one of the commissioned electronic locks. It does not describe the use of the biometric locking system using the fingerprint or thumb print actuated unlocking means to unlock small or large containers holding cannabis or pills.

U.S. Pat. No. 9,355,510 of Rick Crigger et al. describes a biometric access control system includes an equipment structure in communication with an identification station, which includes a processor, a user biometric reader, an equipment identification reader, a user interface to display categories of equipment authorized for use by a user and to receive input from the user including an indication to acquire or return the piece of equipment and a selection of an equipment category and a selection of a specific piece of equipment of the selected equipment category. The equipment structure includes storage locations for storing pieces of equipment assigned to the storage locations, and locks corresponding to the storage locations for individually securing the pieces of equipment to the structure, wherein an authorization signal from the identification station is receivable to release a lock containing the selected specific piece of equipment to permit removal of the selected specific piece of equipment.

This patent describes a sophisticated weapon storage system using biometric components but does not use the biometric locking system using the fingerprint or thumb print actuation unlocking means to unlock a pill or cannabis container.

US Patent Application Publication No. 2017/0046898 of Steven D. Cabouli describes a Biometric and Bluetooth enabled vehicle Console and Glove Box Lock that provides a unique apparatus for locking enclosures such as any locking compartment within a vehicle as well as the vehicle doors, vehicle hood and vehicle trunk locks, and the like, with indirect operational control by the means of a smartphone, tablet or a computer. The Biometric and Bluetooth enabled vehicle Console and Glove Box Lock contains a biometric based fingerprint authentication module, and a Bluetooth/RF COMM communication enabled module, to prevent a non-owner or unauthorized user from accessing the device.

This patent describes a Biometric and Bluetooth enabled vehicle Console and Glove Box Lock that provides a unique apparatus for locking enclosures such as any locking compartment within a vehicle but does not involve the process of biometric locking containers used for Cannabis and Pills. It does not offer the unique feature of the ratchet configuration on a container engaging with the mating ratchet members on the biometric locking mechanism of the jar.

US Patent Application Publication No. 2016/0360351 of Steven D. Cabouli describes a Biometric and Bluetooth Enabled Case Lock System and method that provides a unique apparatus for locking enclosures such as luggage, briefcases, lockers, lock boxes and cabinets, and the like, with indirect operational control by the means of a smart phone, tablet or a computer. The Biometric and Bluetooth Enabled Case Lock system contains a biometric based fingerprint authentication module, and a Bluetooth communication enabled module, to prevent a non-owner or unauthorized user from accessing the device. An on-board system processor controls and interprets commands passed from the user's external Bluetooth device, whereby said case lock system is controllable via an application on a smartphone, tablet or a computer.

This patent describes a Biometric and Bluetooth Enabled Case Lock System that provides a unique apparatus for locking enclosures such as luggage, briefcases, lockers, lock boxes and cabinets but does not offer a safe, airtight containers using a unique style of biometric locking mechanism in the storage of Pills or Cannabis.

None of the foregoing prior art teaches or suggests the particular unique features of the Biometric Locking Jar with Integrated Vacuum Pump and thus clarifies the need for further improvements in the devices that can be used for these purposes.

In this respect, before explaining at least one embodiment of the Biometric Locking Jar with Integrated Vacuum Pump in detail it is to be understood that the design is not limited in its application to the details of construction and to the arrangement of the components set forth in the following description or illustrated in the drawings. The Biometric Locking Jar with Integrated Vacuum Pump are capable of other embodiments and of being practiced and carried out in various ways. Also, it is to be understood that the phraseology and terminology employed herein are for the purpose of description and should not be regarded as limiting.

SUMMARY OF THE INVENTION

The primary advantage of the Biometric Locking Jar with Integrated Vacuum Pump is to provide an adequate safe and secure means to store substances in an airtight environment, such as Cannabis, edibles or pills that may be harmful to adults or children if left in open unsecured containers.

Another advantage of the Biometric Locking Cannabis/Pill Containers is that they are locked by the means of unique biometric locking device operated only by the fingerprint or thumb print activation means.

Another advantage of the Biometric Locking Jar with Integrated Vacuum Pump is the battery indicator lights displaying green for sensor activation and red for low battery power along with the fact that the units will remain open when the battery has run out of power.

Another advantage of the Biometric Locking Jar with Integrated Vacuum Pump is that by holding the products in a sealed airtight environment it will extend their useable life span.

The advantage of the preferred embodiment of the Biometric Locking Jar with Integrated Vacuum Pump is its scalability from small size prescription bottles up to large size 50 gallon drums, and airtight sealing capability throughout the entire size range.

Another advantage of the preferred embodiment of the Biometric Locking Jar with Integrated Vacuum Pump is that they will optionally have several different interchangeable product organization and containment means.

The advantage of the alternate embodiment of the Biometric Locking Jar with Integrated Vacuum Pump is that it is scalable to a size that can hold larger quantities of substances within an airtight sealing and locked environment.

Another advantage of the alternate embodiment of the Biometric Locking Jar with Integrated Vacuum Pump is it can have several optional different internal styles of holding cavities.

Another advantage of the alternate embodiment of the Biometric Locking Jar with Integrated Vacuum Pump is it can come with a rotatable disk on a shoulder screw with an opening to separately isolate each of the holding cavities.

Another advantage of the alternate embodiment of the Biometric Locking Jar with Integrated Vacuum Pump is it will have a threaded lid that will rotate down to tighten against an O-ring sealing means.

Another advantage of the alternate embodiment of the Biometric Locking Jar with Integrated Vacuum Pump is it will only need a ninety degree to one hundred and eighty degree turn to tighten the lid against the O-ring seal.

Another advantage of the alternate embodiment of the Biometric Locking Jar with Integrated Vacuum Pump is it will have the biometric locking mechanism on the underside of the lid with two ratchet or gear style engaging arms that have the capability of securely locating at any two locations on the ratchet or gear configuration above the threads on the upper edge surface of the jar.

Another advantage of the alternate embodiment of the Biometric Locking Jar with Integrated Vacuum Pump is it will make the ratcheting sound when rotating the lid down and the ratchet locking member will be retracted by the means of the unique Biometric Locking device operated only by a fingerprint or thumb print activation means.

Another advantage of the alternate embodiment of the Biometric Locking Jar with Integrated Vacuum Pump is the jar will preferably be made from a smoke tinted tempered glass but could be made from a high-grade smoke tinted polymer, thermoplastic, stainless steel or a composite material and still remain within the scope of this application.

Another advantage of the alternate embodiment of the Biometric Locking Jar with Integrated Vacuum Pump is that it can be manufactured in a variety of different sizes from small personal sizes up to very large sizes to be used in stores that sell products like Cannabis, edibles or pills which require a secure easy opening and sealing means of storage where a sales person only needs to put their thumb print or fingerprint on the biometric lock to unlock lid and turn the lid ninety degrees to one hundred and eighty degrees to open the jar and then replace and relock the lid after the sale is completed.

These together with other advantages of the Biometric Locking Jar with Integrated Vacuum Pump, along with the various features of novelty, which characterize the design are pointed out with particularity in the claims annexed to and forming a part of this disclosure. For a better understanding of the Biometric Locking Jar with Integrated Vacuum Pump, their operating advantages and the specific objects attained by its uses, reference should be made to the accompanying drawings and descriptive matter in which there are illustrated preferred embodiments of the Biometric Locking Jar with Integrated Vacuum Pump. There has thus been outlined, rather broadly, the more important features of the design in order that the detailed description thereof that follows may be better understood, and in order that the present contribution to the art may be better appreciated. There are additional features of the Biometric Locking Jar with Integrated Vacuum Pump that will be described hereinafter, and which will form the subject matter of the claims appended hereto.

The preferred embodiment of the Biometric Locking Jar with Integrated Vacuum Pump with a built-in electric pump has an electric pump that is activated through a power button; After a few seconds the electric pump will have extracted all air inside the jar/bottle and the lid cannot be removed because of the vacuum created, making it virtually impossible to remove it. The jar/bottle can then be opened once the user's enrolled fingerprint touches the fingerprint reader, thus powering on the electric pump which after a few seconds of operating independently will insert enough air inside to break the seal and allow to remove the lid from the jar/bottle.

The Biometric Locking Jar with Integrated Vacuum Pump will consist of a top lid containing the biometric locking mechanism operated by the means of the finger or thumb activation means and a locking bar. The top lid is hinged to bottom portion having a variety of different storage means and will snap into the locked position when closed. The Container will have battery indicator LED lights displaying a green LED light for sensor activation and red LED light for low battery power along with the fact that the unit will remain open when the battery has run out of power. This will insure that Compact Biometric Locking Cannabis/Pill Container will not be locked shut with a dead battery. The locking bar of the Biometric Locking mechanism will engage in the mating locking tabs at the open end of the bottom portion. One internal storage means will be for sealed or unsealed tubes of material like cigars, edibles or Cannabis. Another option will have a variety of cavities with separate lids similar to conventional pill storage containers.

The alternate embodiment of the Biometric Locking Jar with Integrated Vacuum Pump will consist of a smoked tempered glass or a high-grade smoke tinted polymer, thermoplastic, stainless steel or a composite material. This dark tinted jar will provide UV protection for the contents. The upper edge surface of the Jar will have a ratchet or gear style of locking surface which will engage with a mating surface on the locking arms of the Biometric locking mechanism located on the underside of the lid. The Containers will have battery indicator LED lights displaying green for sensor activation and red for low battery power along with the fact that the unit will remain open when the battery has run out of power to ensure that it cannot be locked shut with a dead battery. The lid will screw down on the Jar against an O-ring seal by turning the handle ninety to one hundred and eighty degrees making a ratcheting sound. The O-ring will provide a water-resistant seal and the resulting container will be airtight, watertight, smell-proof in either the case or the jar configuration.

The Biometric Locking Jar with Integrated Vacuum Pump can have varying organizational inserts dividing the central area into different cavities that may optionally have a rotatable disk on a shoulder screw with an opening to separately isolate each of the holding cavities. It can be manufactured in a variety of different sizes from small personal sizes up to very large sizes to be used in stores that sell products that need to be kept in a locked controlled environment.

With respect to the above description then, it is to be realized that the optimum dimensional relationships for the parts of the Biometric Locking Jar with Integrated Vacuum Pump, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the Biometric Locking Jar with Integrated Vacuum Pump.

Further, since numerous modifications and changes will readily occur to those skilled in the art, it is not desired to limit the Biometric Locking Jar with Integrated Vacuum Pump to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Biometric Locking Cannabis/Pill Containers and together with the description, serve to explain the principles of this application.

FIG. 4 depicts the alternate embodiment of the Biometric Locking Cannabis/Pill Container with organizational inserts dividing the central area into different organization cavities and the lid exploded away.

FIG. 5 depicts the alternate embodiment of the Biometric Locking Cannabis/Pill Container with organizational inserts dividing the central area into different organization cavities with a rotatable disk, a shoulder screw and an opening to separately isolate each of the holding cavities.

FIG. 6 depicts the lid exposing the underside of the Biometric Locking Cannabis/Pill Container.

DETAILED DESCRIPTION OF THE PREFERRED EMBODIMENTS

As required, the detailed embodiments of the present Biometric Locking Cannabis/Pill Containers 10A, 10B, 10C, 10D, 10E, 10F and the Biometric Locking Jar with Integrated Vacuum Pump 10G are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present design in virtually any appropriately detailed structure.

Figures 1, 2, 3:
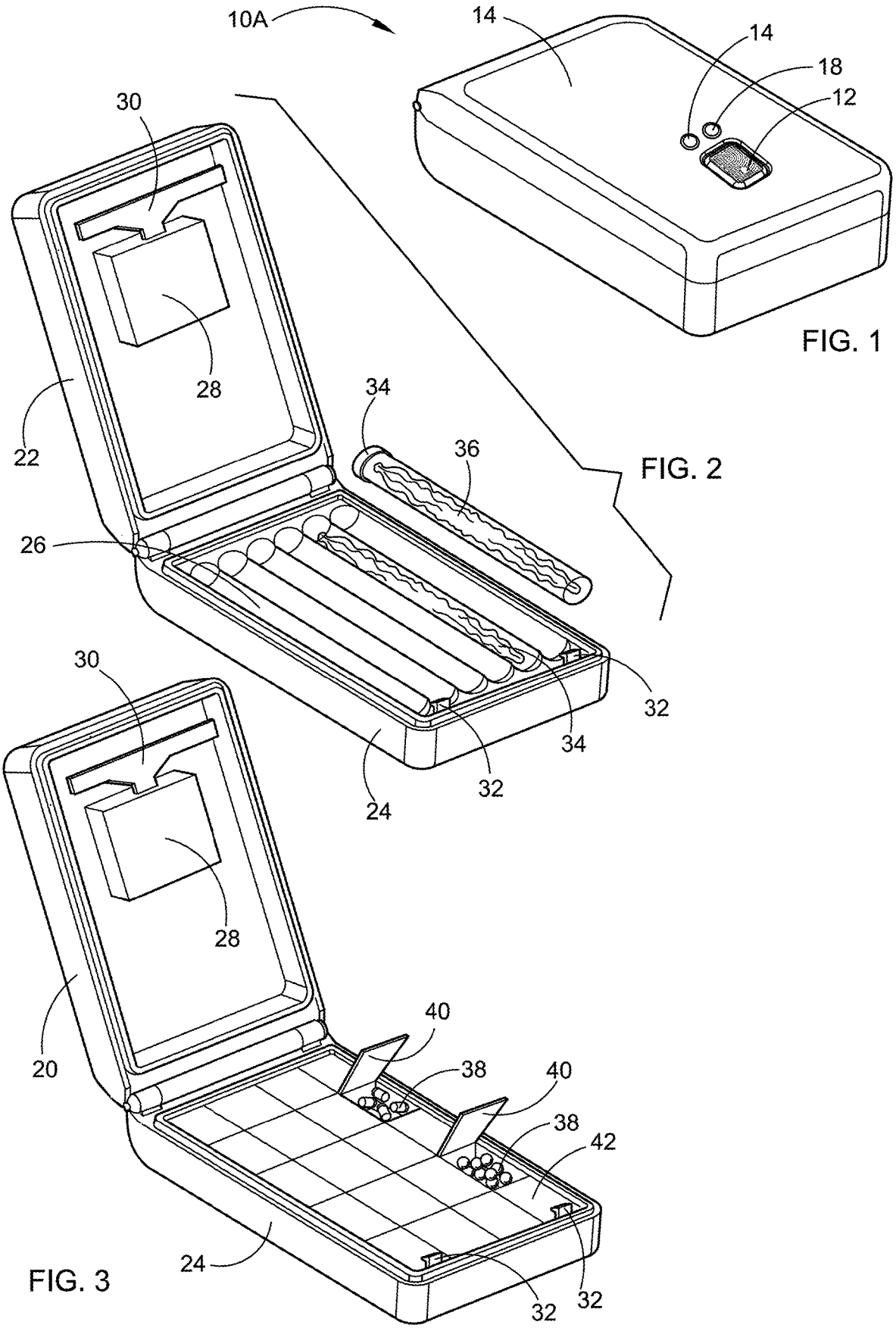
FIG. 1 depicts a Compact Biometric Locking Cannabis/Pill Container in the closed position with the biometric finger or thumb print activation opening mechanism on the top surface.
FIG. 2 depicts a Compact Biometric Locking Cannabis/Pill Container in the open position with the tubular storage means and the Biometric Locking mechanism exposed.
FIG. 3 depicts a Compact Biometric Locking Cannabis/Pill Container in the open position with a pill organization and storage area in the bottom portion.

FIG. 1 depicts a Compact Biometric Locking Cannabis/Pill Container 10A in the closed position with the biometric finger or thumb print activation opening mechanism 12 on the container top surface 14. Adjacent to the activation mechanism 12 is a red LED light 16 indicating low battery power and a green LED light 18 displaying opening activation. A rubber seal 20 runs around the perimeter of both the container top 22 and the container bottom 24 to create the airtight seal. This compact configuration resembles a wallet and can be easily carried in a user's pocket keeping the contents safe from unauthorized access. These containers can vary in size from the convenient pocket size to larger display sizes and still remain within the scope of this application.

FIG. 2 depicts a Compact Biometric Locking Cannabis/Pill Container 10A with the container top 22 in the open position exposing the tubular storage means 26 and the Biometric Locking mechanism 28. The locking bar 30 on the Biometric Locking mechanism 28 will automatically engage within the locking tabs 32 on the front edge of the container bottom 24 when the device is closed. A sealed tubular container 34 containing Cannabis 36 is exploded away.

FIG. 3 depicts a Compact Biometric Locking Cannabis/Pill Container 10A in the open position with the Biometric Locking mechanism 28 in the container top 22 and the pill storage area 38 with compartment lids 40 on each compartment 42 in the container bottom 24.

FIG. 4 depicts the alternate embodiment of the Biometric Locking Cannabis/Pill Container 10B consisting of a smoked glass or possibly high-grade smoke polymer container 48. The Biometric Locking Cannabis/Pill Container 10B will have a ratchet or gear style of locking surface 50 on the upper edge surface 52 which will engage with a mating surface on the locking arms 54 of the biometric locking mechanism 56 located on the underside of the lid. Threads 58 and an O-ring 60 will be below the ratchet or gear style of locking surface 50. An insert 62 can be used to divide the central area into different cavities 64. The Jar lid 66 will have the finger or thumb unlocking means 12 with the red LED light 16 indicating low battery power and a green LED light 18 displaying sensor activation.

FIG. 5 depicts the alternate embodiment of the Biometric Locking Cannabis/Pill Container 10B with inserts 62 dividing the central area into different cavities 64 with rotatable disk 68 on a shoulder screw 70 with an opening 72 to separately isolate each of the holding cavities 64.

FIG. 6 depicts the underside of the Biometric Locking Cannabis/Pill Container Jar 10B lid 66, illustrating the location of one of the Biometric Locking arms of 54.

Figure 7:
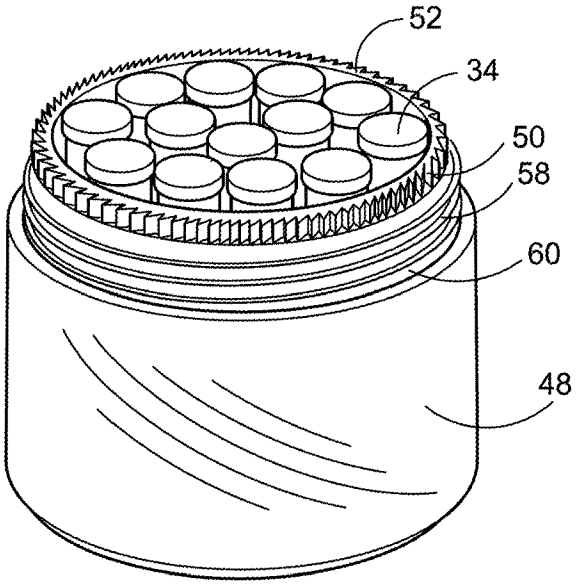
FIG. 7 depicts an open Biometric Locking Cannabis/Pill Container exposing sealed tubular cylinders.

FIG. 7 depicts an open Biometric Locking Cannabis/Pill Container 10B exposing sealed tubular cylinders 34 with a portion of Cannabis 36 exploded away.

Figure 8:
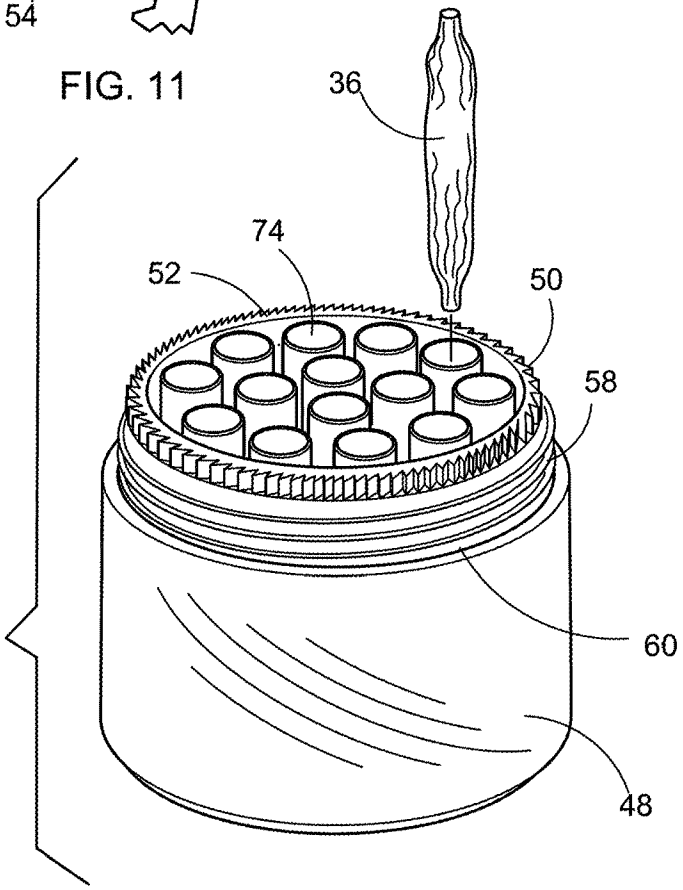
FIG. 8 depicts an open Biometric Locking Cannabis/Pill Container with open tubular cylinders.

FIG. 8 depicts an open Biometric Locking Cannabis/Pill Container 10B with open tubular cylinders 74.

Figure 9:
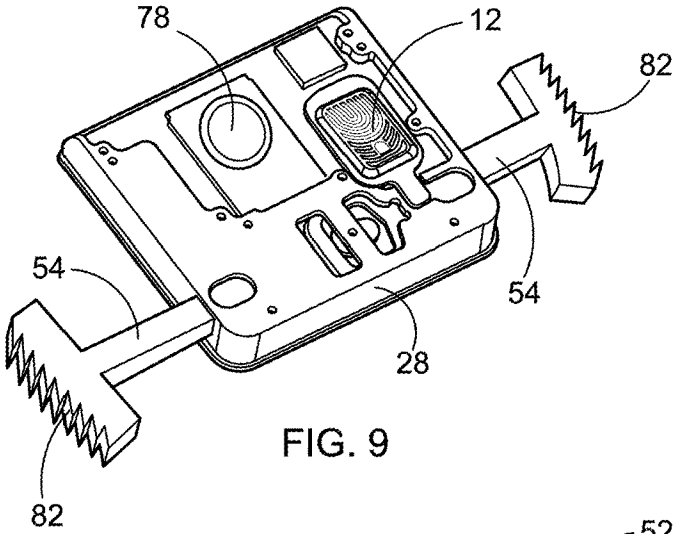
FIG. 9 depicts the underside of the biometric locking mechanism.

FIG. 9 depicts the underside of the Biometric Locking mechanism 28 illustrating the finger and thumb activation sensor 12, the battery 78 and the locking arms 54. At the end of each of the locking arms 54 are the locking heads 82 that will engage in the unique style of locking upper edge surface 52 of the smoked glass or high-grade smoke polymer container 48.

Figure 10:
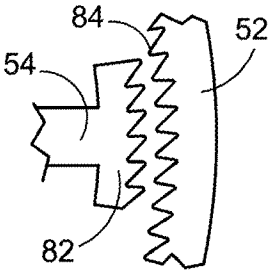
FIG. 10 depicts the ratchet style of the locking mechanism.

FIG. 10 depicts the ratchet style of locking mechanism with a ratchet configuration 84 on the locking head 82 of the Biometric Locking mechanism 28 and a mating style of the ratchet configuration 84 on the Jar upper edge surface 52.

Figure 11:
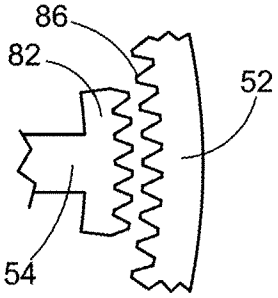
FIG. 11 depicts the gear style of the locking mechanism.

FIG. 11 depicts the gear style of locking mechanism with a common gear configuration 84 on the locking heads of the Biometric Locking mechanism 28 and a mating style of the common gear configuration 86 on the Jar upper edge surface 52.

Figure 12:
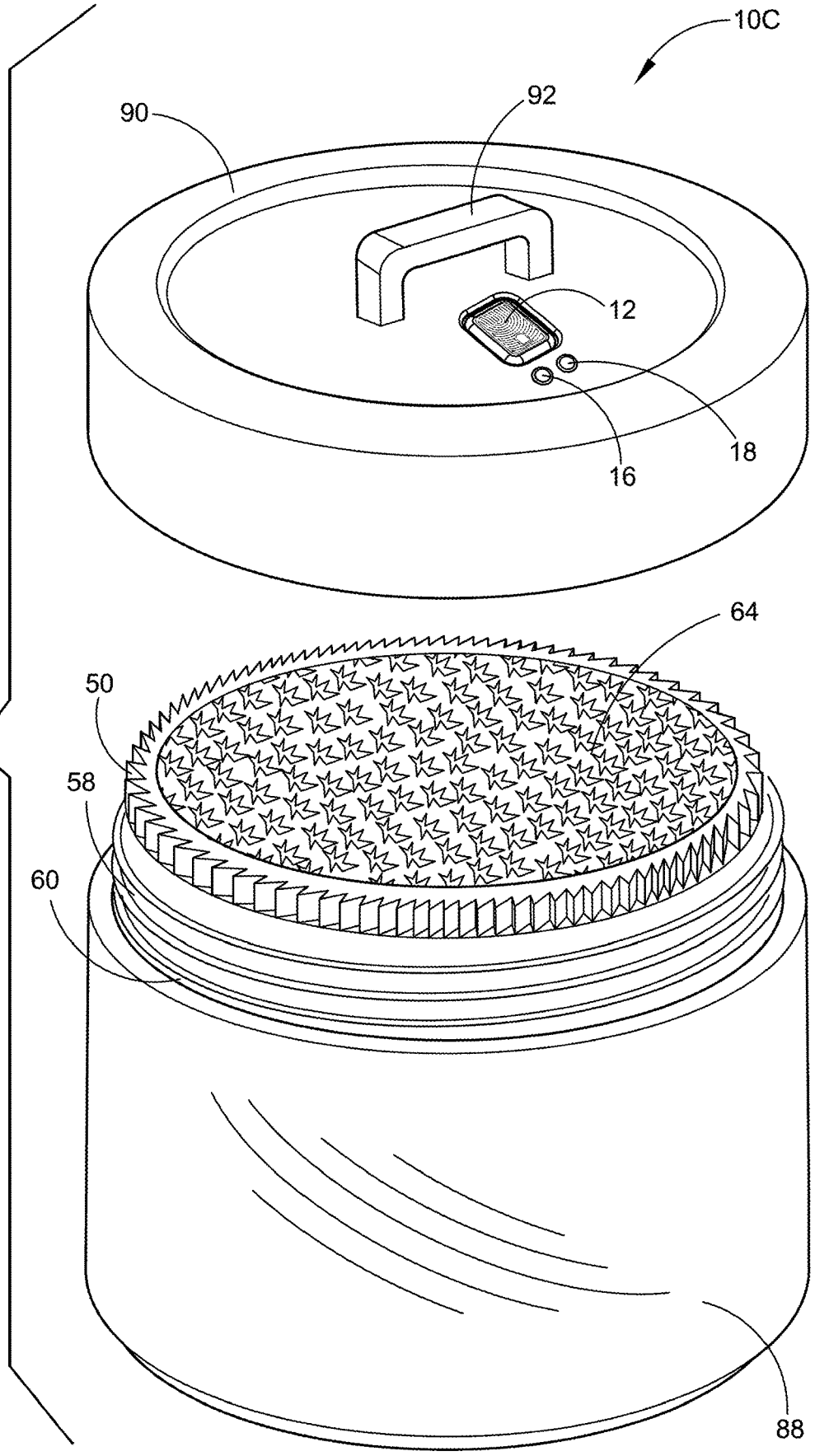
FIG. 12 depicts a large Biometric Locking Cannabis/Pill Container having a screw on lid with the handle and finger or thumb activation means.

FIG. 12 depicts a large Biometric Locking Cannabis/Pill Container 10C consisting of a smoked glass or possibly high-grade smoke polymer 88 having the screw on lid 90 with the handle 92 and finger or thumb activation means 12 filled with Cannabis 64. The large Jar lid 66 will have the activation finger or thumb locking means 12 with the red LED light 16 indicating low battery power and a green LED light 18 displaying sensor activation. It is anticipated that many sizes of jars may be employed, including small, medium size and large to very large containers, all equipped with a biometric locking mechanism within the lid assembly.

Figure 13:
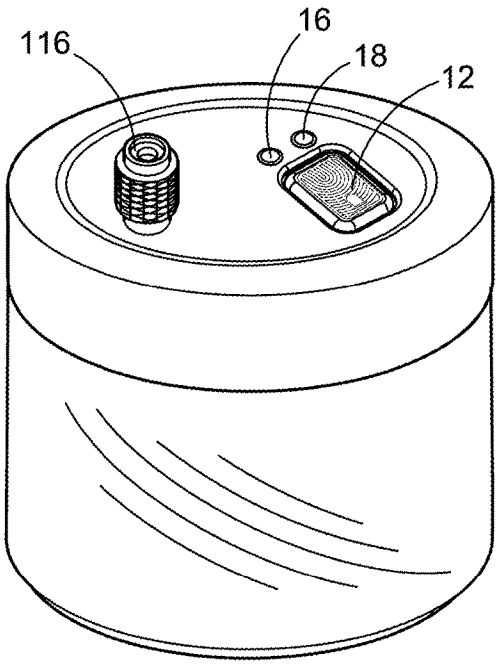
FIG. 13 depicts a large Biometric Locking Cannabis/Pill Container having a screw on lid with the handle and finger or thumb activation means, illustrating a vacuum pump connection fitting mounted on the top of the lid.
Figure 14:
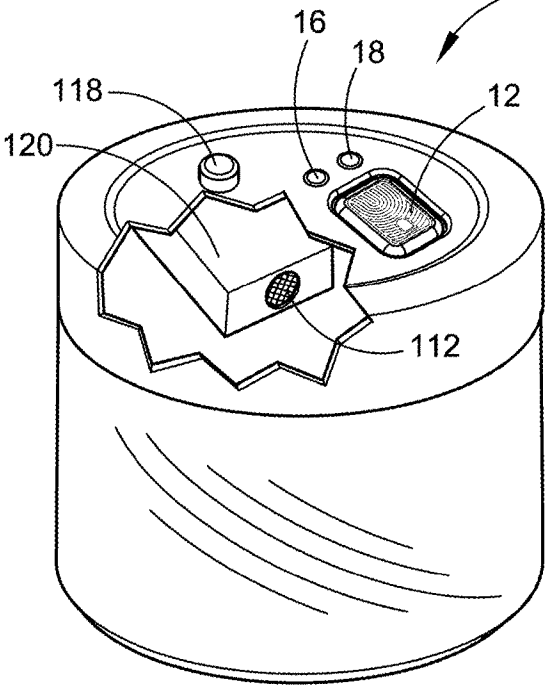
FIG. 14 depicts a large Biometric Locking Cannabis/Pill Container having a screw on lid with the handle and finger or thumb activation means, illustrating an electrically operated vacuum pump mounted within the lid.

FIG. 13 depicts a large Biometric Locking Cannabis/Pill Container having a screw on lid 10D with the finger or thumb print activation means, illustrating a vacuum pump connection fitting 116 mounted on the top of the lid. To create a vacuum inside the Biometric Locking Cannabis/Pill Container 10D the vacuum pump connection fitting 116 would be connected to a hose running from a vacuum pump, then the pump turned on and vacuum inside the container would result. In this way, numerous containers could be connected in series and a vacuum created in each, or they could be connected on at a time to create a vacuum within the several containers FIG. 14 depicts a large Jar Biometric Locking Cannabis/Pill Container having a screw on lid 10E with the finger or thumb biometric activation means, illustrating an electrically operated vacuum pump 120 mounted within the lid. This electrically operated vacuum pump 120 would be turned on and off using the on/off button switch 118. When the electrically operated vacuum pump 120 is turned on it would pull a vacuum from the container through screen 112 which would keep particles from entering the electrically operated vacuum pump 120. This electrically operated pump could be powered by the biometric locking mechanism battery or have its own on-board battery for a power source. It is anticipated that lithium-ion batteries would be employed.

Figure 15:
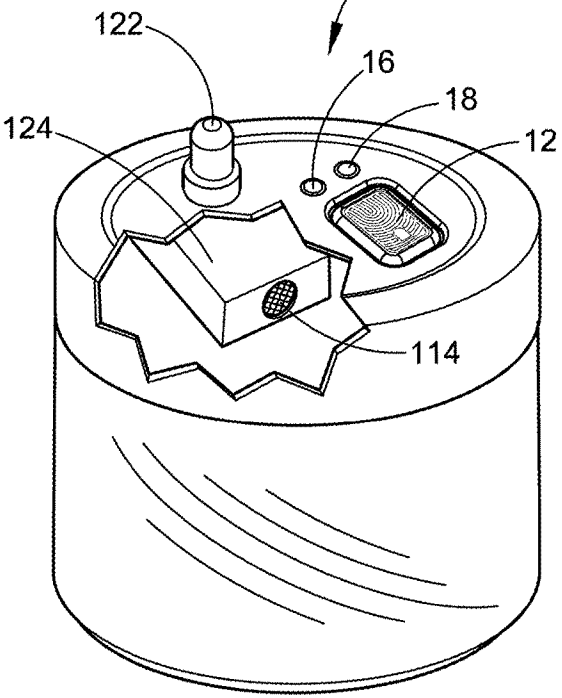
FIG. 15 depicts a large Biometric Locking Cannabis/Pill Container having a screw on lid with the handle and finger or thumb activation means, illustrating a manually operated vacuum pump mounted within the lid.

FIG. 15 depicts a large Jar Biometric Locking Cannabis/Pill Container having a screw on lid 10F with the biometric finger or thumb print activation means, illustrating a manually operated vacuum pump 124 mounted within the lid. The manually operated vacuum pump 124 is operated by pumping up and down on the pump button 122. This pumping action creates a vacuum within the container. As the pumping action of button 122 continued, a vacuum would be pulled within the container through screen 114 which would keep particles from entering the electrically operated vacuum pump 124.

Figure 16:
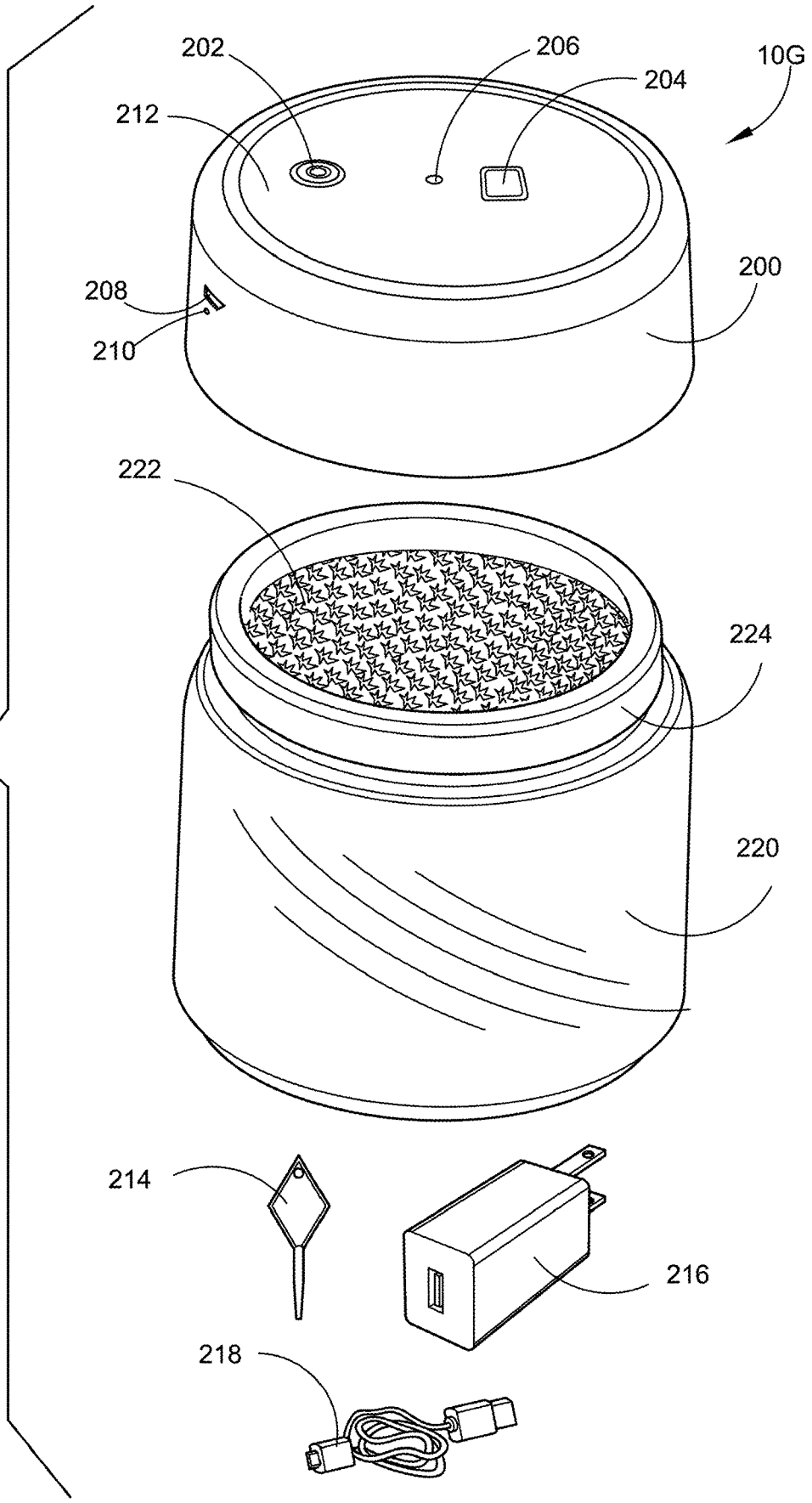
FIG. 16 depicts a full product kit for the Biometric Locking Jar with Integrated Vacuum Pump including the lid, the jar, a fingerprint enrollment key, a USB charger and a charging cord.

FIG. 16 depicts a full product kit for the Biometric Locking Jar with Integrated Vacuum Pump 10G including the locking lid 200, the jar 220, a fingerprint enrollment key 214, a USB charger 216 and a charging cord 218. Located on the top surface 212 of the locking lid 200 are an ON/OFF button 202, a fingerprint enrollment/reader 204, and an indicator LED light 206. Located on the side of the locking lid 200 are a USB charging cord port 208 and an air vent 210. The jar 220 shows contents 222 within the container and a smooth locking lid interface rim 224 described in greater detail below. In operation, when the ON/OFF button 202 is pushed, the vacuum pump is activated and pulls a vacuum within the jar, thereby sealing and securing the lid thereon. To release the sealed inner vacuum within the jar, a user must use an authorized enrolled fingerprint, swipe the finger across the fingerprint enrollment/reader 204 and this will release the vacuum through the air vent 210. The jar 220 may be made out of glass, thermoplastic, stainless steel or a composite material.

Figure 17:
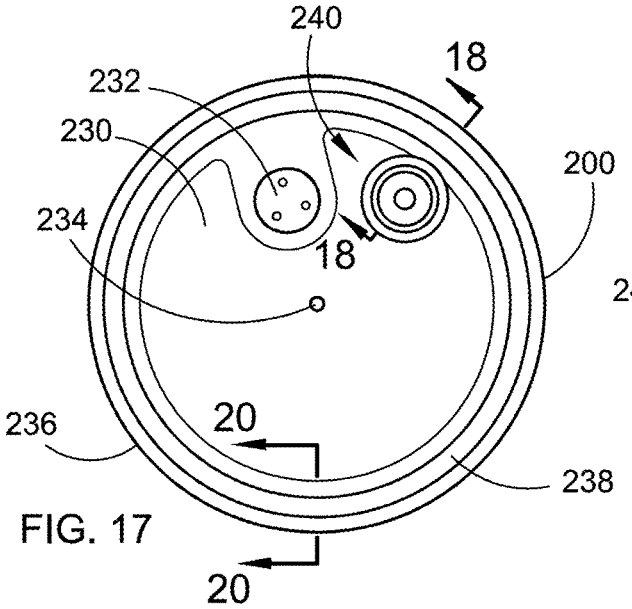
FIG. 17 depicts a bottom view of the biometric locking lid.

FIG. 17 depicts a bottom view of the biometric locking lid 200. Features of the lower surface 230 of the lid include an air vent assembly 232, a fingerprint enrolling/reset button 234, and vacuum intake/check valve/filter element assembly 240 described in greater detail below. Along the circumference of the outer shell 236 of the biometric locking lid is a jar rim accepting and sealing groove 238. In operation, when pulling a vacuum, air is drawn from the jar through the vacuum intake/check valve/filter element assembly 240. The filter element 242 is positioned to ensure that dust and particles are not sent into the vacuum pump (not shown here, but described in greater detail below). In operation, the fingerprint enrollment key 214 (see FIG. 16) is inserted into the fingerprint enrolling/reset button 234 to enroll a user's fingerprint and to reset the CPU microprocessor and fingerprint enrolling feature within the biometric locking lid 200.

Figure 18:
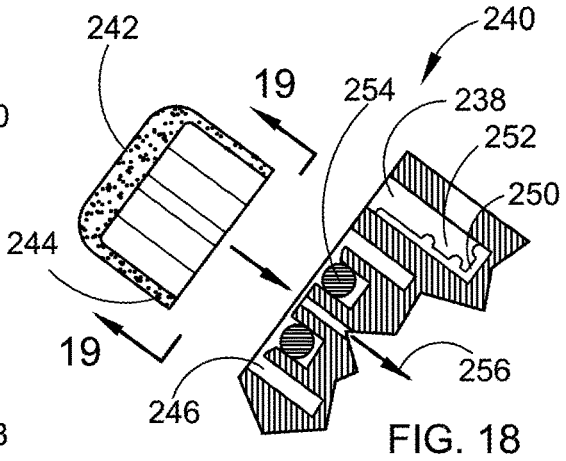
FIG. 18 depicts a cross sectional view of the vacuum valve/check valve/filter element assembly.

FIG. 18 depicts a cross sectional view of the vacuum intake/check valve/filter element assembly 240. The filter element 242 has sides which fit into grooves 246 and is sealed by O-ring 254. Air from the inside of the jar is drawn through the port centrally located in the vacuum intake/check valve/filter element assembly 240 in the direction of arrow 256.

Figure 19:
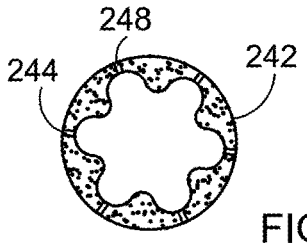
FIG. 19 depicts a bottom view of the filter element illustrating the flower lobe configuration of the filter.

FIG. 19 depicts a bottom view of the filter element 242 illustrating the flower lobe 248 configuration of the filter element cup sides 244.

Figure 20:
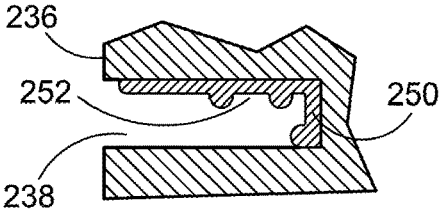
FIG. 20 depicts a cross sectional view of the labyrinth seal jar interfacing gasket running around the perimeter of the outer portion of the lid.

FIG. 20 depicts a cross sectional view of the labyrinth seal lid/jar interfacing gasket 250 running around the perimeter groove 238 of the outer portion 236 of the biometric locking lid 200. The labyrinth seal lid/jar interfacing gasket 250 includes a double bump side portion 252 of the gasket 250 to ensure a better seal, and to hold the vacuum generated within the jar. A microprocessor housed within the lid 200 (see FIG. 23) may be programmed to automatically activate the battery operated vacuum pump also housed within the lid 200 to pull a vacuum every three to seven days or so, to ensure that the generated vacuum within the jar 220 is not lost and the lid 200 remains securely attached to the jar 220.

Figure 21:
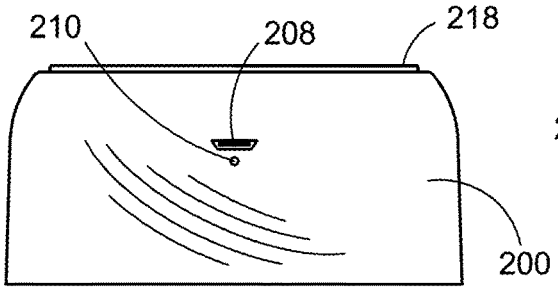
FIG. 21 depicts a side view of the lacking lid, illustrating the position of the USB charging port and the air vent orifice.

FIG. 21 depicts a side view of the biometric locking lid 200, showing the upper surface of the biometric locking lid 218, and illustrating the position of the USB charging port 208 and the air vent orifice 210 located on the sides of the biometric locking lid 200.

Figure 22:
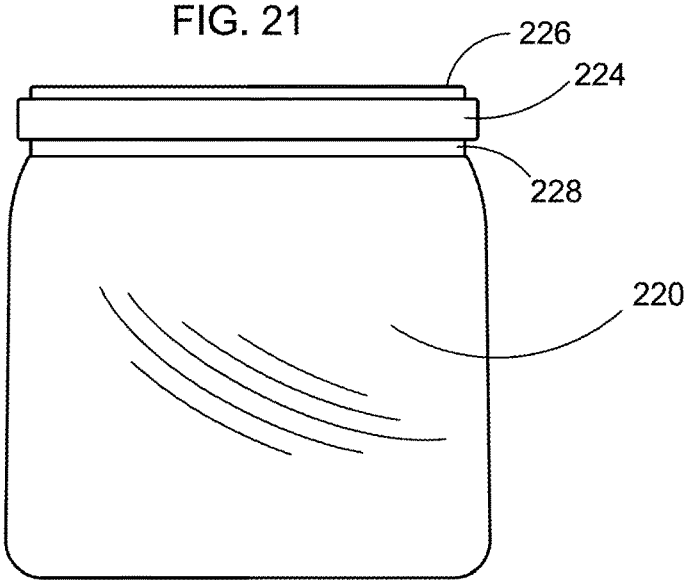
FIG. 22 depicts a side view of the jar illustrating the lid interface rim located at the upper portion of the jar.

FIG. 22 depicts a side view of the jar container 220 illustrating the biometric locking lid interface rim middle portion 224 located at the upper portion of the jar. The biometric locking lid interface rim middle portion 224 has a recessed upper portion 226 and an equally recessed lower portion 228. The upper portion 226 and the biometric locking lid interface rim middle portion 224 both interface with the labyrinth seal lid/jar interfacing gasket 250 with the double bump side portion 252 interfacing with the rim middle portion 224 and the gasket 250 interfacing with the upper portion 226. The resulting seal effectively holds a vacuum pulled within the jar 220.

Figure 23:
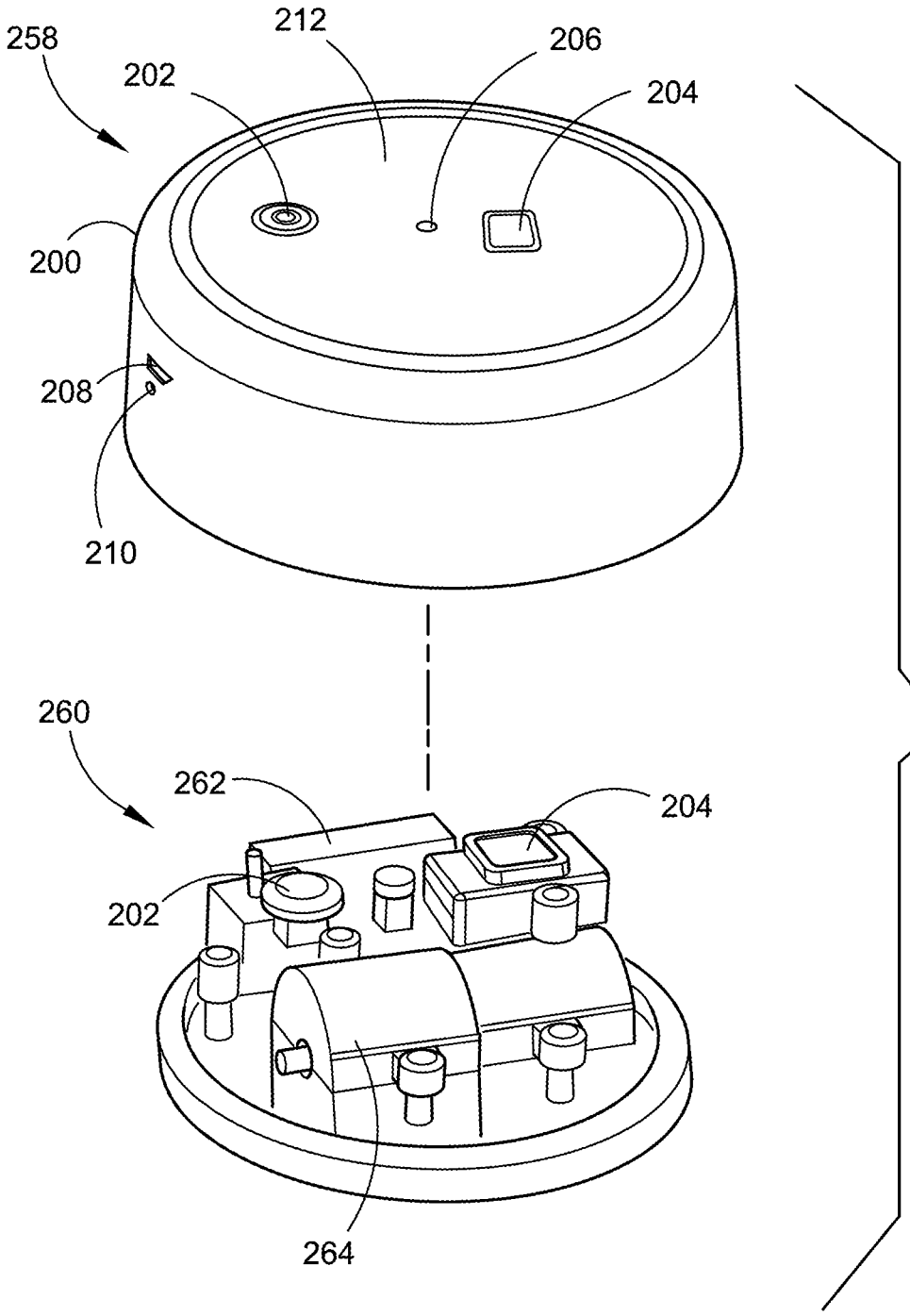
FIG. 23 depicts an exploded view of the lid showing the inner mechanism including the battery and electrically powered vacuum pump components.

FIG. 23 depicts an exploded view of the biometric locking lid 200 with the upper lid cover 258 removed from the inner mechanism frame 260 which supports the battery/CPU microprocessor 262 and vacuum pump 264 components. The biometric locking lid 200 with the upper lid cover 258 includes the upper surface of the lid 212 which has an ON/OFF button 202, a fingerprint enrollment/reader 204, and an indicator LED light 206, as well as the USB charging cord port 208 and an air vent 210 located on the side of the biometric locking lid cover 258. When assembled, the lid cover 258 encloses the inner mechanism frame 260 which supports the battery/CPU microprocessor 262 and vacuum pump 264 components, while also exposing the ON/OFF button 202 and the fingerprint enrollment/reader 204.

Figure 24B:
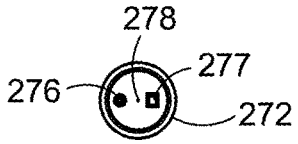
FIG. 24B illustrates a top view of the biometric locking lid on the prescription bottle shown in FIG. 24A.
Figure 24A:
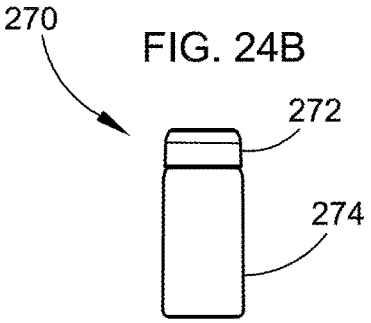
FIG. 24A depicts a prescription bottle having a biometric locking lid thereon.

FIG. 24A depicts a conventional prescription bottle 270 having a biometric locking lid 272, constructed in accordance with the present invention, positioned on top of a conventional prescription pill or medicine container 274 commonly used to dispense and store prescriptions and over the counter medications. The inner components of the fingerprint reader and vacuum pump are miniaturized and housed within the biometric locking lid 272. When the fingerprint reader activates the vacuum pump, a vacuum is pulled within the conventional prescription bottle 274, in accordance with the present invention. FIG. 24B illustrates a top view of the biometric locking lid 272, including an ON/OFF button 276, a fingerprint enrollment/reader 277, and an LED indicator light 278.

Figure 25B:
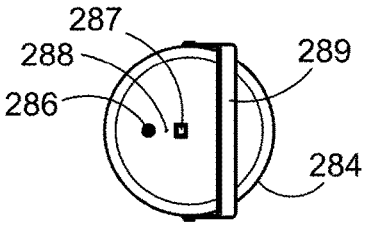
FIG. 25B illustrates a top view of the biometric locking lid on the 5, 10 or 15 gallon pail shown in FIG. 25A.
Figure 25A:
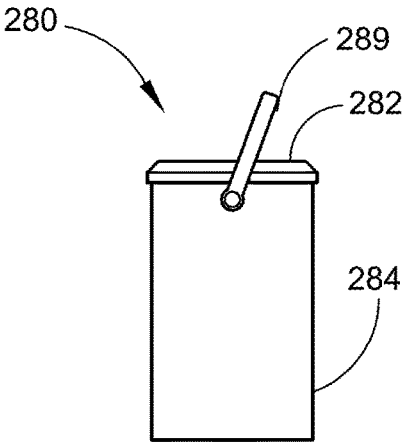
FIG. 25A depicts a 5, 10 or 15 gallon pail having a biometric locking lid thereon.

FIG. 25A depicts a conventional 5, 10 or 15 gallon pail having a biometric locking lid thereon 280. The conventional 5, 10 or 15 gallon pail 284 includes a biometric locking lid 282 and a handle 289, constructed in accordance with the present invention, positioned on top of a 5, 10 or 15 gallon pail container 284 commonly used today to dispense and store larger volumes of valuable substances that may require securing from unauthorized access. The inner components of the fingerprint reader and vacuum pump are housed within the biometric locking lid 282. When the fingerprint reader activates the vacuum pump, a vacuum is pulled within the conventional 5, 10 or 15 gallon pail 284, in accordance with the present invention. FIG. 25B illustrates a top view of the biometric locking lid 282, including an ON/OFF button 286, a fingerprint enrollment/reader 287, and an LED indicator light 288, and a handle 289.

Figure 26B:
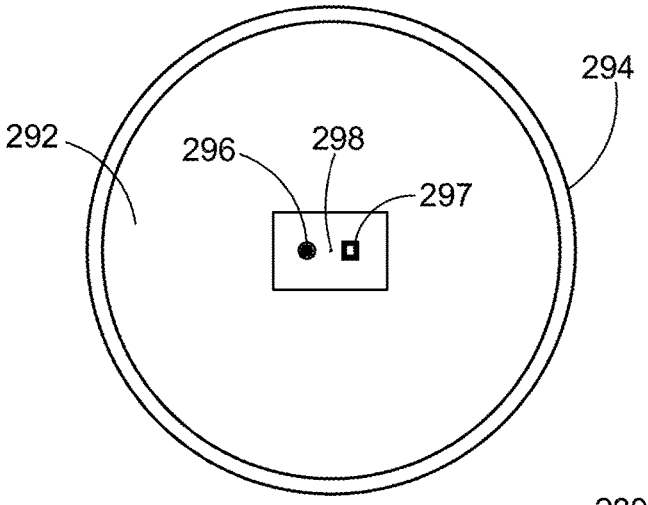
FIG. 26B illustrates a top view of the biometric locking lid on the 50 gallon drum shown in FIG. 26A.
Figure 26A:
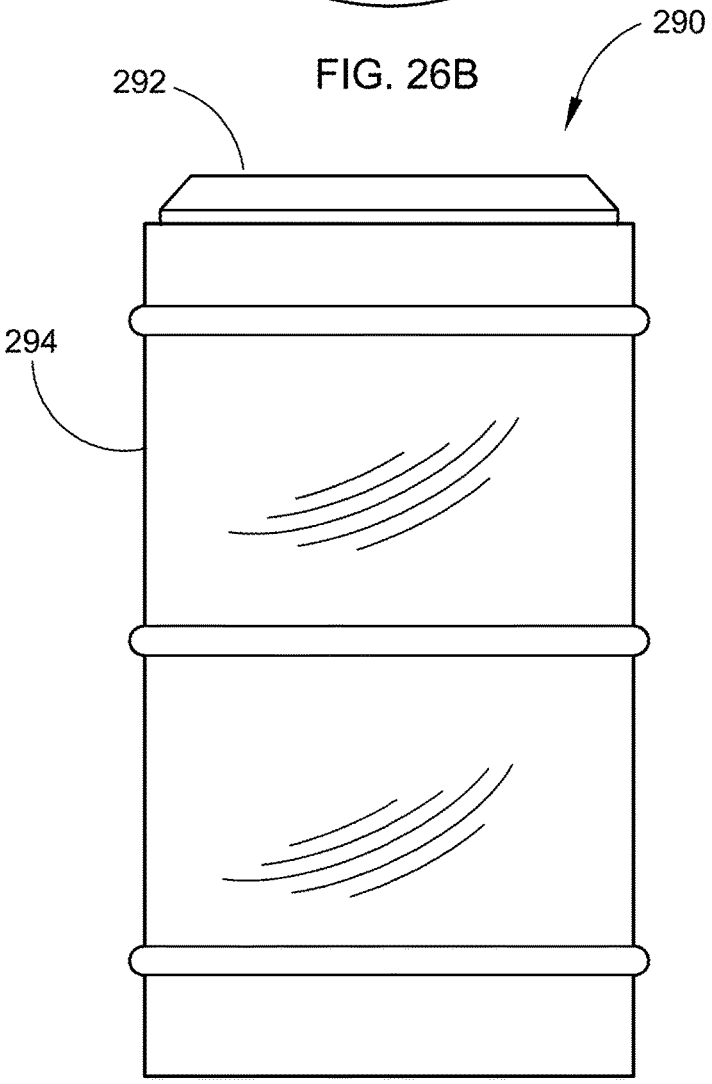
FIG. 26A depicts a 50 gallon drum having a biometric locking lid, thereon.

FIG. 26 depicts a 50 gallon drum having a biometric locking lid thereon 290. The conventional 50 gallon drum 294 includes a biometric locking lid 292, constructed in accordance with the present invention, positioned on top of the 50 gallon drum container 294 commonly used today to dispense and store larger volumes of valuable substances that may require securing from unauthorized access. The inner components of the fingerprint reader and vacuum pump are housed within the biometric locking lid 292. When the fingerprint reader activates the vacuum pump, a vacuum is pulled within the conventional 50 gallon drum 294, in accordance with the present invention. FIG. 26B illustrates a top view of the biometric locking lid 292, including an ON/OFF button 296, a fingerprint enrollment/reader 297, and an LED indicator light 298.

The Biometric Locking Cannabis/Pill Containers 10A, 10B 10C, 10D, 10E, 10F and the Biometric Locking Jar with Integrated Vacuum Pump 10G shown in the drawings and described in detail herein disclose arrangements of elements of particular construction and configuration for illustrating preferred embodiments of structure and method of operation of the present design. It is to be understood, however, that elements of different construction and configuration and other arrangements thereof, other than those illustrated and described may be employed for providing a Biometric Locking Cannabis/Pill Containers 10A, 10B 10C, 10D, 10E, 10F and the Biometric Locking Jar with Integrated Vacuum Pump 10G in accordance with the spirit of this application, and such changes, alternations and modifications as would occur to those skilled in the art are considered to be within the scope of this application as broadly defined in the appended claims.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or may, unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Further, the purpose of the foregoing abstract is to enable the U.S. Patent and Trademark Office, foreign patent offices worldwide and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A biometric locking jar with integrated vacuum pump comprising:

(a) a lid having a lid upper portion and a lid lower portion wherein said lid upper portion houses an ON/OFF button, the vacuum pump, a CPU/microprocessor and a fingerprint enrollment/reader;

(b) the jar having a lid interfacing rim; and (c) said lid lower portion includes a labyrinth seal lid interfacing gasket;

wherein said ON/OFF button activates said vacuum pump which pulls a vacuum within said jar and said vacuum within said jar solely acts to securely lock said lid to said jar without the need for a secondary mechanical locking mechanism;

and further wherein the generated vacuum is released using recognition of an enrolled user's fingerprint to allow unlocking of the jar solely by the release of said vacuum and thereby allowing access to the jar contents.

2. The biometric locking jar with integrated vacuum pump according to claim 1, wherein said lid lower portion further includes the vacuum pump having a vacuum intake/check valve/filter element assembly for drawing air out of the jar.

3. The biometric locking jar with integrated vacuum pump according to claim 2, wherein said vacuum pump having the vacuum intake/check valve/filter element assembly is CPU/microprocessor controlled and electrically powered.

4. The biometric locking jar with integrated vacuum pump according to claim 3, wherein said electrically powered vacuum pump is battery powered.

5. The biometric locking jar with integrated vacuum pump according to claim 1, wherein said fingerprint scanner enrollment/reader includes a reset/enrollment button which resets said fingerprint scanner enrollment/reader and allows a user to enroll an authorized fingerprint or thumb print.

6. The biometric locking jar with integrated vacuum pump according to claim 5, wherein said fingerprint scanner enrollment/reader is CPU/microprocessor controlled and electrically powered.

7. The biometric locking jar with integrated vacuum pump according to claim 1, wherein said lid lower portion labyrinth seal lid gasket includes a double bump side portion to securely hold a vacuum pulled within said jar.

8. The biometric locking jar with integrated vacuum pump according to claim 1, wherein said jar having the lid interfacing rim includes an upper portion and a locking lid interface rim middle portion both of which interface with said labyrinth seal interfacing gasket.

9. The biometric locking jar with integrated vacuum pump according to claim 1, wherein said lid upper portion includes an air vent and a universal serial bus charging port.

10. The biometric locking jar with integrated vacuum pump according to claim 1, wherein said lid upper portion includes an indicator light emitting diode.

11. A method for making a biometric locking jar with integrated vacuum pump, comprising the steps of:

(a) providing a lid having a lid upper portion and a lid lower portion wherein said lid upper portion houses an ON/OFF button, the vacuum pump, a CPU/microprocessor and a fingerprint enrollment/reader;

(b) providing the jar having a lid interfacing rim; and (c) providing said lid lower portion includes a labyrinth seal lid interfacing gasket;

wherein said ON/OFF button activates said vacuum pump which pulls a vacuum within said jar and said vacuum within said jar solely acts to securely lock said lid to said jar without the need for a secondary mechanical locking mechanism;

and further wherein the generated vacuum is released using recognition of an enrolled user's fingerprint to allow unlocking of the jar solely by the release of said vacuum and thereby allowing access to the jar contents.

12. The method for making a biometric locking jar with integrated vacuum pump according to claim 11, wherein said lid lower portion further includes the vacuum pump having a vacuum intake/check valve/filter element assembly for drawing air out of the jar.

13. The method for making a biometric locking jar with integrated vacuum pump according to claim 12, wherein said vacuum pump having the vacuum intake/check valve/filter element assembly is CPU/microprocessor controlled and electrically powered.

14. The method for making a biometric locking jar with integrated vacuum pump according to claim 13, wherein said electrically powered vacuum pump is battery powered.

15. The method for making a biometric locking jar with integrated vacuum pump according to claim 11, wherein said fingerprint scanner enrollment/reader includes a reset/enrollment button which resets said fingerprint scanner enrollment/reader and allows a user to enroll an authorized fingerprint or thumb print.

16. The method for making a biometric locking jar with integrated vacuum pump according to claim 15, wherein said fingerprint scanner enrollment/reader is CPU/microprocessor controlled and electrically powered.

17. The method for making a biometric locking jar with integrated vacuum pump according to claim 11, wherein said lid lower portion labyrinth seal lid gasket includes a double bump side portion to securely hold a vacuum pulled within said jar.

18. The method for making a biometric locking jar with integrated vacuum pump according to claim 11, wherein said jar having the lid interfacing rim includes an upper portion and a locking lid interface rim middle portion both of which interface with said labyrinth seal interfacing gasket.

19. The method for making a biometric locking jar with integrated vacuum pump according to claim 11, wherein said lid upper portion includes an air vent and a universal serial bus charging port.

20. The method for making a biometric locking jar with integrated vacuum pump according to claim 11, wherein said lid upper portion includes an indicator light emitting diode.

* * * * *